United States Patent [19]

Dannhauer

[11] Patent Number: 4,631,644

[45] Date of Patent: Dec. 23, 1986

[54] PORTABLE LAMP, ADAPTED TO BE WORN ON THE HEAD OF A USER

[75] Inventor: Günter Dannhauer, Grünwald, Fed. Rep. of Germany

[73] Assignee: Patent-Treuhand-Gesellschaft fur elektrische Glühlampen mbH, Munich, Fed. Rep. of Germany

[21] Appl. No.: 752,156

[22] Filed: Jul. 3, 1985

[30] Foreign Application Priority Data

Jul. 17, 1984 [DE] Fed. Rep. of Germany ..... 3426358

[51] Int. Cl.[4] ..... A42B 1/24; F21L 15/14; F21L 15/08

[52] U.S. Cl. ..... 362/105; 362/103; 362/106

[58] Field of Search ..... 362/105, 106, 103

[56] References Cited

U.S. PATENT DOCUMENTS

| | | | |
|---|---|---|---|
| 1,121,247 | 12/1914 | Hirsch | 362/106 |
| 3,133,705 | 5/1964 | Eickelman | 362/106 |
| 3,745,993 | 7/1973 | Feinbloom | 362/105 |
| 4,199,802 | 4/1980 | Malm | 362/105 |
| 4,530,112 | 7/1985 | Cecala et al. | 362/105 |

FOREIGN PATENT DOCUMENTS

| | | | |
|---|---|---|---|
| 1109044 | 4/1966 | United Kingdom | 362/105 |

*Primary Examiner*—Raymond A. Nelli

*Attorney, Agent, or Firm*—Frishauf, Holtz, Goodman & Woodward

[57] ABSTRACT

To provide for adjustability of the direction of light from a lamp unit (3), preferably retaining a halogen incandescent lamp (13), the lamp unit is retained on a headband (4) by a ball-and-socket joint (6) secured, in part, to an angle element (5), in which the angle legs (5*a*, 5*b*) are angled by about 115°, the lamp unit (3) being a lightweight molded plastic unit, connected by a cable (2) to a battery housing (1) for supply of electrical energy. Preferably, the battery housing also includes a receptor for the ball of the ball-and-socket joint, so that the lamp unit (3) can be attached to the battery housing (1). The headband is universally adjustable by a VELCRO® fastener, the lamp, also, carrying a VELCRO® attachment, for individual attachment to the headband; the angle unit, likewise, is attachable by a VELCRO fastener to the headband for positioning at selected locations.

8 Claims, 2 Drawing Figures

PORTABLE LAMP, ADAPTED TO BE WORN ON THE HEAD OF A USER

The present invention relates to a portable lamp, and more particularly to a lamp which is adapted to be worn on the head of a user, to provide illumination while the user is engaged in various activities while it is dark, and to free the hands of the user, while directing the light where needed.

BACKGROUND

It has previously been proposed to separate a source of electrical energy, for example flashlight batteries, rechargeable batteries or the like, from a light source, and to connect a housing retaining the electrical energy source to a lamp unit by a cable. The lamp unit itself may be carried in various ways, for example on the arm, wrist, or belt, or on the head. Lamp units to be carried on the head, particularly for use by mountaineers and climbers have been known which, however, typically provide for attachment of a standard flashlamp on a headband, so that the headband has to support not only the lamp unit, but the batteries as well. In some arrangements, the battery housings may be separated and are adapted to be carried, for example on the belt of the user and connected by a cable; in some other installations, the battery unit is separated from the lamp unit itself and likewise attached to the headband. In many such structures, however, the relatively heavy batteries must be carried on the headband. Other units are so arranged that the batteries and lamp unit itself are combined in a single housing, adapted to be worn, for example, on the belt.

Some lamps have been provided in which a separate light, or lamp unit is secured to the headband by an attachment element which projects from the headband. Such an arrangement requires a connector which has a substantial projection distance from the headband itself in order to permit adjustment of the angle of the headlamp with respect to the head; this attachment element, in turn, must be retained against the head by a relatively stiff backup unit or structure which is uncomfortable to wear, while providing only limited directivity to the reflector or lamp unit. Since the reflector or lamp unit projects away from the head, it is subject to damage upon movement of the head if the additional projecting distance is not adequately considered.

THE INVENTION

It is an object to provide a portable light source or lamp which is adapted to be worn on the head of a user, which is light, versatile in use, and easily adjustable for directing the light, and which can be located close to the head of the user.

Briefly, a carrying headband, preferably infinitely adjustable by a VELCRO® closure, has attached thereto one leg of an angle element, the other leg of the angle element preferably being offset with the first angle by about 115°; the lamp unit itself, which can be made of lightweight plastic and furnished with a halogen incandescent lamp, is attached to the second leg of the angle element by a universal joint, for example and preferably a ball-and-socket joint, molded on the angle element, and on the lamp-reflector housing, respectively, and interengageable by an interference fit. Electrical power for the halogen incandescent lamp is provided by a cable which is attached to a remote carried battery holder.

The arrangement has the advantage that the lamp-reflector unit can be readily separated from the headband; the headband is infinitely adjustable, and the angle unit permits placement of the lamp-reflector unit close to the head, while being adjustable in position due to the universal adjustability of the ball-and-socket connection.

DRAWINGS

FIG. 1 is a schematic side view of the headlamp and battery housing unit, illustrating the lamp in two positions, one in solid and one in broken lines; and FIG. 2 is a top view of the battery unit and illustrating the arrangement with the lamp unit attached to the battery unit.

DETAILED DESCRIPTION

Figure 2:
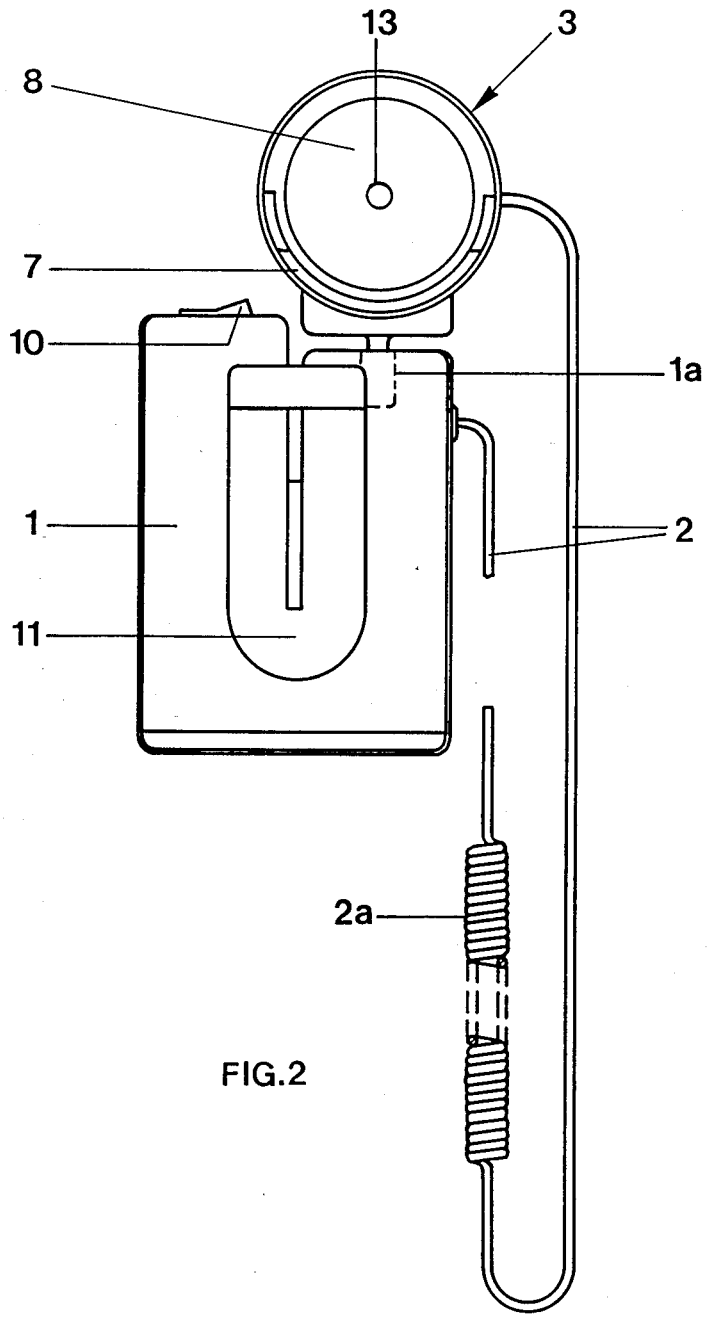

The illumination device in accordance with the present invention has two separate units, a battery housing 1 and a remote lamp unit 3. The housing 1, which can retain primary cells, rechargeable batteries or secondary cells, is connected by a cable 2, which, preferably, includes a spiral cable portion 2*a* (FIG. 2) with the lamp unit 3. Lamp unit 3 is secured to a head carrier band 4 by an intervening holding bracket 5. Holding bracket 5 is an angle element having one angle leg 5*a* attached to the headband 4, and another angle leg 5*b* formed with a receiving socket for a ball-and-socket joint 6, the ball of which is secured to the lamp unit 3. The ball-and-socket joint 6 permits universal adjustability of the unit 3. The leg 5*a* is attached to the front of the head carrier band 4. The rear side of the band may be padded.

The ball-and-socket joint 6 can be constructed in a simple manner. A pin is secured to the head lamp unit 3, for example by being integrally molded thereon, which at the end carries a ball. The ball fits within a cylindrical bore in the leg 5*b* of the angle unit 5, the cylindrical bore having a diameter which is just slightly smaller than the diameter of the ball. By constructing both the angle and the unit 3, or at least the unit 3, of a plastic material which is slightly elastically deformable, the ball can be fitted into the cylindrical bore and the position of the lamp unit 3 with respect to the angle leg 5*a* will be maintained due to frictional force based on the interference fit between the ball and the cylindrical bore of the ball-and-socket joint 6.

In accordance with a preferred feature of the invention, the legs of the angle element 5 are arranged at an angle of about 115°. While this angle is not critical, it has been found particularly advantageous since it permits holding the lamp unit 3 vertically and parallel to the leg unit 5*a*, and hence close to the head of a user, who has strapped the carrier band 4 about the head. Yet, the angle permits wide adjustment of the headlamp unit 3 and pivoting of the lamp unit 3 to a position which may be about 50° away from a vertical plane, that is, over an angle of 50° with respect to the leg portion 5*a*. Wider or larger deflections may be possible by changing the angle or extending the length of the pin between the unit 3 and the ball-and-socket joint 6. A close connection, however, between the bottom of the lamp unit 3 and the ball of the ball-and-socket joint is desirable for good balance. Of course, the relative position of the ball and the socket of the joint 6 on the leg part 5*b* and on the lamp unit 3 may be reversed.

A shield or shading portion 7 is formed on the lower side of the lamp unit 3 which prevents glare from a lamp 13 located within a reflector 14 in the lamp unit 3 from shining into the eyes of a user.

Uniform light distribution is obtained if, in accordance with a feature of the invention, the light source 13 is a low-voltage halogen incandescent lamp, located within a reflector 14, located within, or molded into the lamp unit 3. Preferably, a plastic lens 8 (FIG. 2) which may be formed with profiled or light-directing ribs or prisms, closes off the free side of the lamp unit 3.

The headband 4, in accordance with a preferred feature of the invention, carries on one side of the outside thereof, one part of a peel-off VELCRO ® attachment, the other part of the free headband carrying the counter element. Preferably, the plush side of the VELCRO ® combination faces toward the outside from the headband, and the hook portion of the VELCRO ® fastener towards the inside. Holding loops are preferably provided, to prevent loose portions of the headband from dangling if the headband is adjusted for a very small diameter.

Figure 1:
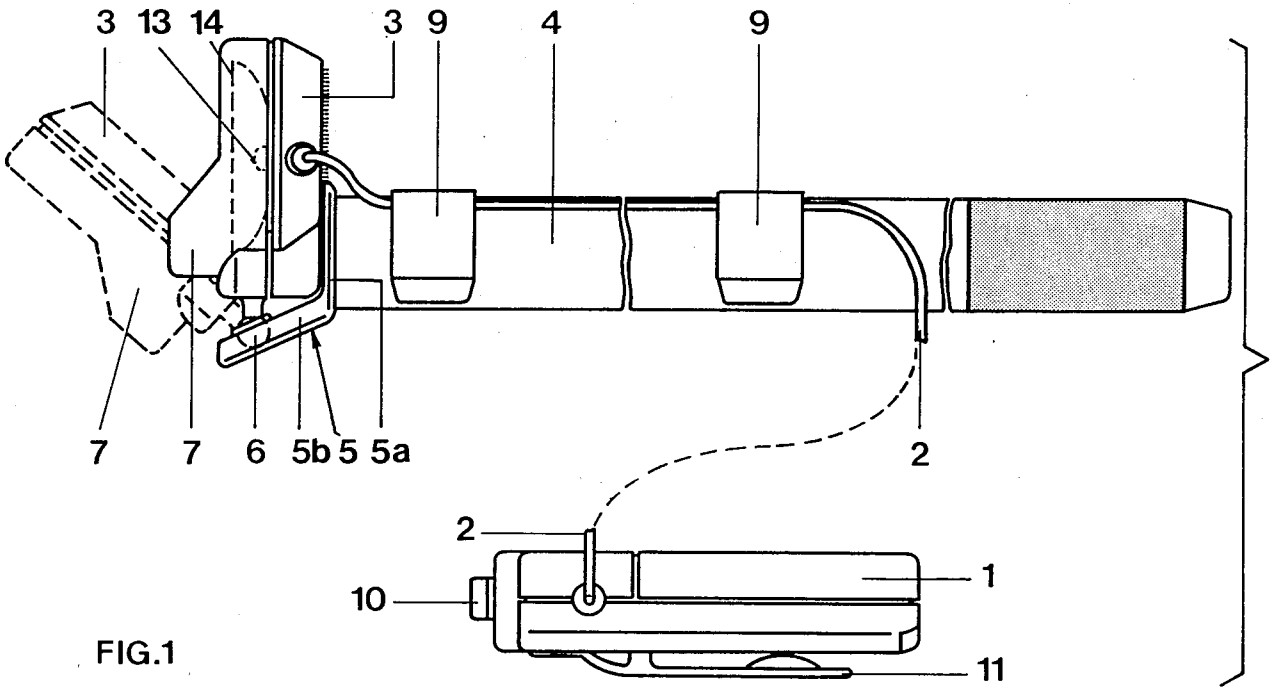

The angle part 5*a* is secured to the carrier band 4 likewise by a portion of VELCRO ®, so arranged that the rearward or right side (with respect to FIG. 1) of the leg portion 5*a* carries the matching part of the VELCRO ® fastener, to match the outwardly facing part of the VELCRO ® fastener of the headband. This permits locating the angle element 5 at any desired position on the headband. The lamp unit 3, preferably, also has a VELCRO ® strip attached thereto so that it can be attached direction to the headband, for example to the portion which is at the outside of the headband 4, when in use, or, selectively, on other portions of equipment which may receive a VELCRO ® attachment. The battery unit 1, for example, may also be furnished with a strip of VELCRO ®, for example for attachment of the headlamp thereto.

The carrier headband 4 has holding straps 9 attached thereto which, also formed with a VELCRO ® strip, provide holding arrangements for the cable 2 to guide the cable along the headband 4. This arrangement prevents dangling of the cable directly off the lamp unit 3, and permits guiding the cable, for example somewhat behind the ear of the user, down along the neck towards the battery housing. The cable 2, preferably, is spiralled at least in part, as shown at 2*a* in FIG. 2, so that it can be readily stretched or matched to various body sizes of the user and becomes independent on the location where the battery unit 1 is carried—in a breast pocket, in a trouser pocket, on a belt, or the like.

The housing unit 1 includes a switch 10 and, further, an opening 1*a*, for example cylindrical, and similar to the opening in the leg unit 5*b* to permit the ball unit of the ball-and-socket joint 6 to be attached to the battery unit directly. The battery unit 1 further has a holding clamp 11; the opening 1*a* is, preferably, located in parallel to the clamp 11 so that, for example, the battery unit 1 can be carried in the breast pocket of a jacket and the lamp unit 3 snapped into the opening 1*a* to provide for forwardly extending illumination with both hands free.

Since the lamp unit 3 is readily separable by the ball-and-socket joint 6 from either the angle 5 or the lamp unit 1, it can be used as a hand-held light source for specific direction of light, for example for repair use in a vehicle at night.

The illumination unit or lamp is primarily provided for sport use. It may be used, for example, by joggers, cross-country skiers and the like, particularly in wintertime when it gets dark early, as an illumination for a selected path or as a warning light for oncoming traffic. The position of the lamp with respect to the selected path can be readily adjusted by moving the lamp unit 3 within the ball-and-socket joint 6, and thereby also permits matching of the direction of the light path to the height of the user.

The light source has a specific advantage for rock climbers and mountaineers; the unit 3, attached to the head, can be very lightweight, formed of lightweight plastic, with a reflector 14 likewise of reflective plastic material. Halogen incandescent lamps, such as lamp 13, provide intense bright light with minimum electrical energy consumption and also are lightweight. Since the energy source, batteries within the housing 1, is remote from the light source itself, carrying the lamp will not interfere with free head movement or cause fatigue. The lamp is also particularly suitable for repair work, for example on vehicles, since the hands are freed and the light can be directed by head movement alone.

Various changes and modifications may be made within the scope of the inventive concept.

I claim:

1. A light-weight, vibration-resistant, head-mounted portable lamp and power source combination, particularly adapted for hands-free recreational and repair activities, comprising:

a housing (1) which can be disposed on the person of the user, remote from the head, a low-voltage power source disposed in said housing;

a lamp unit (3) of light-weight materials including a reflector (14) and a low-voltage halogen incandescent light source (13);

a cable (2) interconnecting the housing and the lamp unit;

a universally adjustable carrying headband (4) capable of being secured around the head of a user and remaining so secured throughout any athletic activity by the user;

and means (5,6) providing a detachable mounting of the lamp unit (3) on the carrying band, including an angle element (5), having first (5*a*) and second (5*b*) portions disposed at angle with respect to each other, said first portion (5*a*) being separably attached to the carrying headband (4) and said second portion (5*b*) projecting slightly from the head of the user; and a single separable ball and socket joint (6) adjustably interconnecting the lamp unit (3) and said angle element (5), at least one of said ball and said socket being formed of elastically deformable material, one part of said ball-and-socket joint being formed in said second portion (5*b*) of said angle element, said angle element being so dimensioned and said joint being so positioned thereon to permit pointing of said light source, selectively, horizontally directly ahead of the user, within a range of about 50° downwardly from the horizontal, rotated around the vertical axis, and any combination of the foregoing.

2. Lamp according to claim 1, wherein the headband (4) comprises an open band having, at respective portions thereof, respective parts of a VELCRO ® fastener.

3. Lamp according to claim 1, wherein said one (5*a*) of the portions of the angle element (5) includes a separable portion of a VELCRO® fastener for attachment to the carrier band (4).

4. Lamp according to claim 3, wherein the attachment parts of the VELCRO® fasteners are arranged for attaching the lamp unit (3) to the outside of the headband.

5. Lamp according to claim 1 further including holding straps (9) secured to the headband at staggered location longitudinally thereof, and attachable to the headband by VELCRO® closures, for guiding the cable (2) along the headband.

6. Lamp according to claim 1, wherein the lamp unit comprises a shield or shade element (7) at a portion thereof positioned adjacent the second part of the movable joint to provide a shade, or glare shield to prevent glare from a light source positioned within the lamp unit.

7. Lamp according to claim 1, further including a movable joint part similar to said first part of the movable joint on the angle element located on the battery housing (1) for selective attachment of the lamp unit to the battery housing.

8. Lamp according to claim 1, wherein said lamp unit comprises a lightweight plastic molded element having a molded reflector (14) positioned therein.

* * * * *